US005143097A

United States Patent [19]

Stephen Sohn et al.

[11] Patent Number: 5,143,097

[45] Date of Patent: * Sep. 1, 1992

[54] TOBACCO RECONSTITUTION PROCESS

[75] Inventors: Edward J. Stephen Sohn, Lewisville; Harvey J. Young, Advance; Edward Bernasek, Winston-Salem, all of N.C.

[73] Assignee: R. J. Reynolds Tobacco Company, Winston-Salem, N.C.

[ * ] Notice: The portion of the term of this patent subsequent to Jan. 29, 2008 has been disclaimed.

[21] Appl. No.: 647,329

[22] Filed: Jan. 28, 1991

[51] Int. Cl.[5] ..... A24B 15/12

[52] U.S. Cl. ..... 131/356; 131/372

[58] Field of Search ..... 131/370, 372, 356

[56] References Cited

U.S. PATENT DOCUMENTS 1,016,844 2/1912 Moonelis .
1,068,403 7/1913 Maier .
3,353,541 11/1967 Hind et al. .
3,386,449 6/1968 Hind .
3,386,450 6/1968 Seligman et al. .
3,398,754 8/1968 Tughan .
3,409,026 11/1968 Hind et al. .
3,411,514 11/1968 Hind et al. .
3,411,515 11/1968 Hind et al. .
3,420,241 1/1969 Hind et al. .
3,428,053 2/1969 Schoenbaum et al. .
3,435,829 4/1969 Hind et al. .
3,464,422 9/1969 Light et al. .
3,483,874 12/1969 Hind .
3,540,455 11/1970 Fiore et al. .
3,616,801 11/1971 Hind .
3,847,164 11/1974 Mattina et al. .
4,421,126 12/1983 Gellatly .
4,674,519 6/1987 Keritsis et al. .
4,962,774 10/1990 Thomasson et al. .
4,972,854 11/1990 Kiernan et al. .
4,987,906 1/1991 Young et al. .

OTHER PUBLICATIONS

*Flavoring Reconstituted Tobacco,* Silberstein, vol. 1, pp. 26–29, TJI (1985).

*Tobacco Encyclopedia,* edited by Voges, pp. 389–390, TJI (1984).

*Primary Examiner*—Richard J. Apley
*Assistant Examiner*—Lynne Reichard

[57] ABSTRACT

Reconstituted tobacco has phosphate salts incorporated therein. Tobacco is extracted with water to yield an insoluble portion and an aqueous portion containing water soluble tobacco components. The aqueous portion is contacted with diammonium hydrogen orthophosphate and adjusted to a pH of about 6.5. The extract then is applied to the insoluble portion which has been formed into a sheet-like shape. The resulting tobacco composition is dried to yield a reconstituted tobacco material.

10 Claims, 1 Drawing Sheet

TOBACCO RECONSTITUTION PROCESS

BACKGROUND OF THE INVENTION

The present invention relates to tobacco processing, and in particular to a method for modifying the flavor attributes of tobacco during a tobacco reconstitution process.

Cigarettes are popular smoking articles which have a substantially cylindrical rod shaped structure and include a charge of tobacco material surrounded by a wrapper, such as paper, thereby forming a so-called "tobacco rod." It has become desirable to manufacture a cigarette having a cylindrical filter aligned in an end-to-end relationship with the tobacco rod. Typically, a filter includes cellulose acetate circumscribed by plug wrap, and is attached to the tobacco rod using a circumscribing tipping material. See, Baker, *Prog. Ener. Combust. Sci.*, Vol. 7 pp. 135–153 (1981).

Typical cigarettes include blends of various tobaccos, such as the flue-cured, Burley, Md. and Oriental tobaccos. Cigarette blends also can include certain amounts of processed and reconstituted tobacco materials. Reconstituted tobacco materials often are manufactured from tobacco stems, dust and scrap using papermaking processes. See, *Tobacco Encyclopedia*, edit. by Voges, pp. 389–390, TJI (1984) and U.S. Pat. Nos. 4,962,774 to Thomasson et al and 4,987,906 to Young et al. See, also, U.S. Pat. No. 4,421,126 to Gellatly.

It would be desirable to provide an efficient and effective process for altering the sensory (e.g., flavor, aroma, harshness, mildness and aftertaste) attributes of tobacco during a reconstitution process.

SUMMARY OF THE INVENTION

The present invention relates to a process for providing a reconstituted tobacco material. The process involves extracting components from tobacco using a solvent having an aqueous character. As such, an aqueous tobacco extract and a water insoluble tobacco portion are provided. At least a portion of the aqueous extract is separated from the insoluble portion. The insoluble portion then is formed into a desired shape (e.g., a sheet-like shape). The aqueous tobacco extract is contacted with a water soluble phosphate salt, and then the pH of that aqueous tobacco extract is adjusted so as to be near neutral. The aqueous tobacco extract in contact with the phosphate salt (e.g., the phosphate containing aqueous tobacco extract) then is applied to the formed insoluble portion; and the resulting tobacco composition is dried to the desired moisture level, thereby providing a reconstituted tobacco material which has been treated with a water soluble phosphate salt. As such, a phosphate-containing reconstituted tobacco material is provided.

The resulting reconstituted tobacco material can be employed using techniques known in the art. For example, the reconstituted tobacco material can be provided in a sheet-like form having a thickness approximating that of tobacco leaf lamina; and the material can be blended with other tobacco materials, cut to the desired size, and employed as smokable cut filler for the manufacture of cigarettes.

Reconstituted tobacco materials which are manufactured according to the process of the present invention have excellent smoking properties and improved sensory attributes relative to reconstituted tobacco materials similarly manufactured but not incorporating phosphate salts into the reconstitution process.

DETAILED DESCRIPTION OF THE PREFERRED EMBODIMENTS

Figure 1:
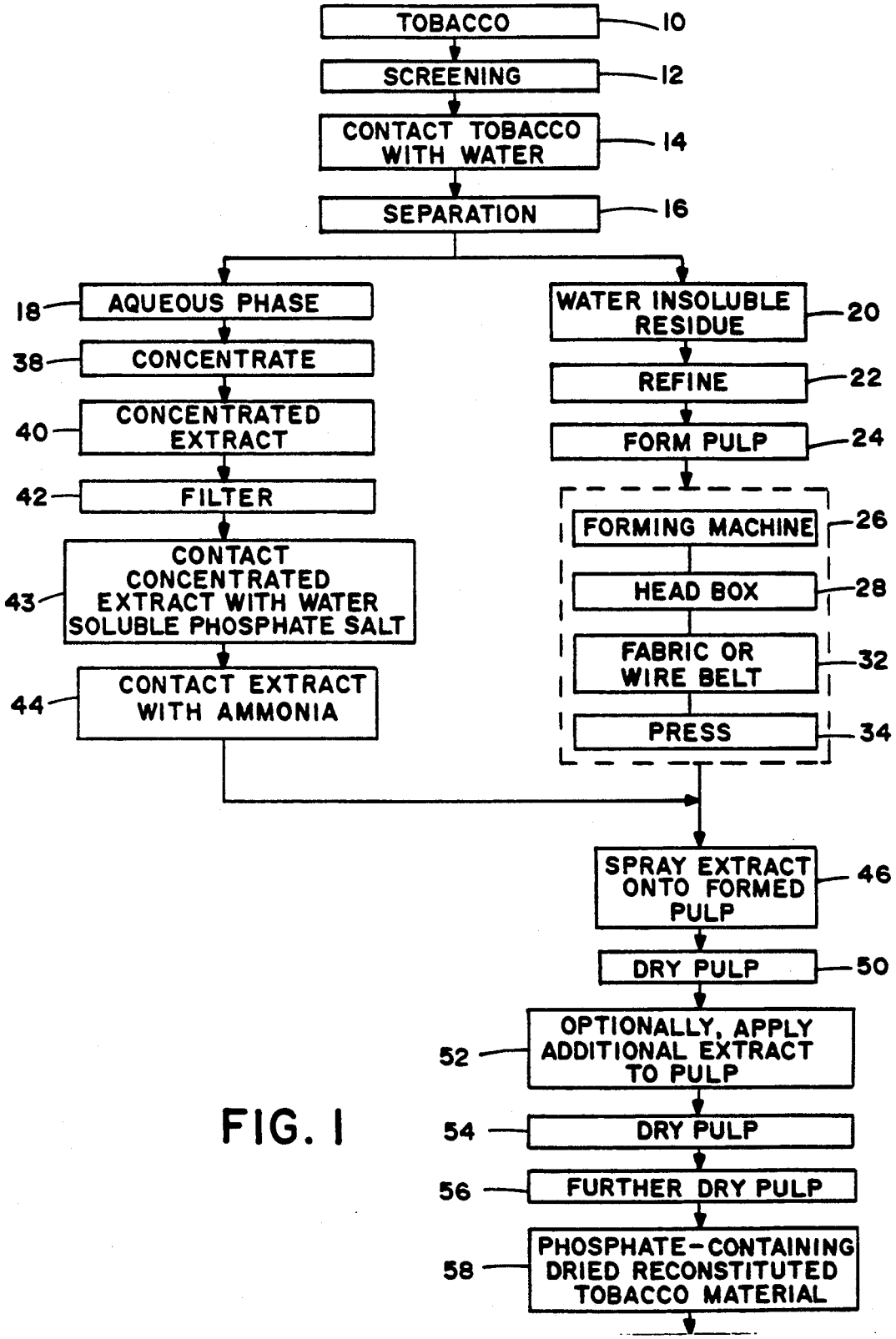
FIG. 1 is a schematic diagram of steps representative of an embodiment of the present invention.

Referring to FIG. 1, tobacco material 10 can have the form of stem, dust, scrap, strip, or the like. One or more of the aforementioned exemplary tobacco materials can be provided separately, or as blends thereof. The tobacco material can be screened 12 or otherwise processed to remove impurities (e.g., sand) therefrom. Techniques for removing particular impurities from particular tobacco materials can vary, depending upon factors such as the form of the tobacco material being processed; and such techniques will be apparent to the skilled artisan.

The tobacco material is contacted with water 14 under conditions such that water soluble components of the tobacco are extracted by the water. The mixture, which is an aqueous tobacco slurry, is subjected to separation conditions 16 so as to provide extracted tobacco components in an aqueous phase 18 and a water insoluble residue 20. The manner of separation of the liquid extract from the insoluble residue can vary. Typical separation techniques involve centrifugation, the use of one or more passes of the mixture through a screw press, or the like.

The water insoluble residue 20 can be refined 22 using papermaking type refiners such as disc refiners, conical refiners, or the like. As such, the residue is subjected to a size reduction step and thereby is formed into pulp 24 for use in the subsequent manufacture of a reconstituted tobacco product. The pulp 24 is transferred to a forming machine 26 consisting of a headbox 28, a continuous fabric or wire mesh belt 32, and a series of presses 34. Such a forming machine is common in the papermaking industry. Such a forming machine and the operation thereof will be apparent to the skilled artisan. The pulp is laid onto the fabric or wire mesh belt 32, thereby forming a sheet-like shape, and excess water is released from the pulp using the series of presses 34 after initial dewatering on the fabric or wire belt.

Meanwhile, the liquid extract 18 is concentrated 38 by heating or other such method to evaporate a desired amount of the water. For example, the extract can be passed over steam-filled tubes. Optionally, the concentrated extract 40 is filtered 42 using a screening technique or the like, in order to remove suspended solid materials from the liquid extract. Such a liquid extract normally exhibits a pH of about 5 or less to about 5.5.

The liquid extract is contacted with a water soluble phosphate salt 43 (e.g., an aqueous solution of diammonium hydrogen orthophosphate). The manner in which the liquid extract is contacted with the phosphate salt can vary. The phosphate salt can be charged into the liquid extract, added over time to the liquid extract, or added continuously to a feedline carrying the liquid extract.

The liquid extract is contacted with ammonia 44, so as to increase the pH of the liquid extract. Typically, the pH of the liquid extract is increased to more than about 5.5 to about 8, preferably about 5.6 to about 6.8. Oftentimes, the pH of the liquid extract is increased to a pH of about 6 or more. For example, anhydrous, gaseous ammonia can be introduced into a static mixer, a "scrubber," or the like, so as to contact the phosphate containing liquid extract at a controlled rate. The resulting liquid extract then is applied to the pulp 24 on the fabric or wire mesh belt 32 using a spraying technique 46, or a similar application means (e.g., size press).

The sheet-like pulp having the liquid extract applied thereto is passed through a dryer 50 such as an apron dryer, or the like. If desired, a further amount of the liquid extract 52 can be applied to one or both sides of the dried pulp 54, and the resulting material can be passed through another dryer 56. Alternatively, the resulting material can be passed through the dryer or dryers more than one time. The dried reconstituted tobacco material 58 which results can be collected 60 and is processed further as required for use as smokable filler for cigarettes. For example, the tobacco material 58 can be cased and/or top dressed, cut or shredded to the desired size, heat treated, or otherwise processed.

Tobacco materials used in the process of the present invention can vary. The tobacco materials which are reconstituted according to the present invention are of a form such that, under extraction conditions, a portion thereof is soluble in (i.e., extracted by) the extraction solvent; and a portion thereof is insoluble in (i.e., not extracted by) the extraction solvent. Examples of suitable types of tobaccos include flue-cured, Burley and Maryland tobaccos, although other types of tobacco can be employed. The tobacco material generally has been aged, and can be in the form of laminae and/or stem, or can be in a processed form. Typically, the tobacco material employed is a waste material and/or processing by-product such as fines, dust, scrap or stem. All or part of the tobacco material can be previously cased and/or top dressed. The aforementioned materials can be processed separately, or as blends thereof.

The tobacco material is contacted with a solvent having an aqueous character. Such a solvent consists primarily of water, normally greater than 90 weight percent water, and can be essentially pure water in certain circumstances. Essentially pure water includes deionized water, distilled water and tap water. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the solvent can vary. Typically, the weight of solvent relative to the tobacco material is greater than 4:1, and oftentimes greater than 5:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and solvent is not particularly critical.

The conditions under which the extraction is performed can vary. Typical temperatures range from about 50° F. to about 175° F. The solvent/tobacco material mixture can be agitated (e.g., stirred, shaken, or otherwise mixed) in order to increase the rate at which extraction occurs. Typically, adequate extraction of components occurs in less than about 60 minutes, and oftentimes is less than about 30 minutes. As such, an aqueous tobacco slurry is provided.

The solvent and extracted components are separated from the insoluble residue. The manner of separation of the components of the slurry can vary; however, it is convenient to employ conventional separation means such as filtration, centrifugation, pressing, or the like. Generally, the separation of the components of the slurry is performed while the slurry is maintained at above ambient temperature. It is desirable to provide a solution of solvent and extracted components having a very low level of suspended solids, while removing the greatest amount of solvent from the insoluble residue as is possible. Typically, the separation of the components of the aqueous tobacco slurry is performed in order to provide (i) a damp pulp; and (ii) an aqueous extract having extracted tobacco components therein.

The pulp is formed into a sheet, or other desired shape. Typically, the pulp is laid onto a fabric, screen or wire mesh belt using known papermaking techniques and equipment. Oftentimes, damp pulp is contacted with further aqueous liquid to provide a slurry of sufficiently low solids content so as to have the pulp in a form which can be readily formed as a sheet on a fabric, screen or wire mesh belt. The formed pulp then is treated to remove excess water therefrom by passing the pulp through a series of presses, dryers, vacuum boxes, or the like. Techniques for removing excess water from formed pulp will be apparent to the skilled artisan.

The liquid extract is concentrated. Typically, the aqueous phase is evaporated such that the concentrated extract includes more than about 20 percent extracted tobacco components, preferably about 24 to about 27 percent extracted tobacco components, based on the weight of the extracted components and solvent.

The aqueous tobacco extract then is contacted with a water soluble phosphate salt. Examples of such salts include diammonium hydrogen orthophosphate, ammonium dihydrogen orthophosphate, potassium dihydrogen phosphate, tripotassium phosphate, potassium hydrogen phosphate, sodium dihydrogen phosphate, and the like. Typically, contact is provided when the aqueous tobacco extract is maintained at an elevated temperature between about 110° F. and about 160° F., preferably between about 130° F. and about 140° F. The amount of phosphate salt which is contacted with the aqueous tobacco extract can vary. For example, for a salt such as diammonium hydrogen orthophosphate, about 0.5 g to about 5.0 g, preferably about 1.5 g to about 4.2 g of salt is contacted with each pound of aqueous tobacco extract having about 25 weight percent tobacco extract components therein. That is, it is preferable to contact about 4.3 g to about 12 g of phosphate ion with each pound of tobacco extract, on a dry weight basis. Preferably, the salt is first dissolved in a solvent having an aqueous character, and then contacted with the aqueous tobacco extract. After contact of the salt and aqueous tobacco extract is effected, the resulting mixture normally is maintained at an elevated temperature for about 1 minute to about 1 hour prior to further use.

The concentrated tobacco extract is contacted with the water soluble phosphate salt, and then is contacted with ammonia, or any other suitable reagent capable of providing the liquid extract in the desired pH range of above about 5.5 to about 8. Preferably, the ammonia is essentially anhydrous ammonia or concentrated ammonium hydroxide. Anhydrous ammonia is commercially available, and typically has a purity which exceeds 99 percent. Although the manner of contact can vary, it generally is convenient to inject gaseous ammonia into the region through which the extract is flowing. For example, gaseous anhydrous ammonia can be bubbled through the aqueous extract. Alternatively, a concentrated ammonium hydroxide solution can be pumped into contact with the liquid extract. The amount of ammonia required to provide the liquid extract at the desired pH will be apparent to the skilled artisan. Normally, contact of the ammonia and aqueous tobacco extract occurs at a temperature of about 100° F. to about 200° F., preferably about 110° F. to about 160° F., most preferably about 130° F. to about 140° F.

If desired, certain other components can be incorporated into the aqueous tobacco extract, preferably after both the phosphate salt and ammonia have been contacted with the extract. For example, a compound such as urea, propylene glycol, glycerine, potassium sorbate, sugars, amino acids, flavors such as licorice and cocoa, particulate matter such as carbon particles, organic acids such as citric acid, malic acid and levulinic acid, further tobacco extracts such as high nicotine content tobacco extracts and heat treated tobacco extracts, and the like, and other casing, top dressing and particulate components can be incorporated into the aqueous tobacco extract.

The aqueous tobacco extract then is applied to the formed pulp. For example, the aqueous tobacco extract is uniformly applied to the pulp in a sheet-like form using a series of spray nozzles, a series of sizing rollers, or other such means. However, the manner of applying the aqueous extract is not particularly critical. Normally, the moisture content of the pulp just prior to the time that the aqueous tobacco extract is applied thereto ranges from about 40 to about 80 percent, based on the weight of the pulp and moisture; and a formed pulp having a sheet-like shape is such that the weight thereof is about 3 grams to about 5 grams per square foot. The formed pulp having the aqueous tobacco extract applied thereto is dried to remove moisture therefrom using tunnel-type dryers, or the like. One or more applications of the aqueous tobacco extract can be provided to the formed pulp. The resulting tobacco material is dried to a moisture content of about 10 to about 15 weight percent, preferably to a moisture content of about 12 to about 13 weight percent.

Normally, the amount of phosphate salt present within the resulting reconstituted tobacco material depends upon factors such as (i) the type and dissolved solids content of the extract which is contacted with the phosphate salt, and (ii) the amount of extract which is applied to the pulp to provide the resulting reconstituted tobacco material. For example, an aqueous tobacco extract which comprises about 25 weight percent tobacco extractables is contacted with diammonium hydrogen orthophosphate and then applied to extracted tobacco pulp which is formed into a sheet such that the resulting reconstituted tobacco material has about 35 percent to about 45 percent tobacco water solubles applied thereto (on a dry weight basis), and the resulting reconstituted tobacco material normally exhibits a phosphate content of about 1 to about 2.5 percent, preferably about 1.4 to about 2.0 percent (on a dry weight basis). Normally, such an exemplary reconstituted tobacco material, which is provided using diammonium hydrogen orthophosphate according to the process of the present invention, exhibits an ammonia content of about 0.4 to about 1.2 percent (on a dry weight basis).

The following examples are provided in order to further illustrate various embodiments of the invention but should not be construed as limiting the scope thereof. Unless otherwise noted, all parts and percentages are by weight.

EXAMPLE 1

Reconstituted tobacco sheet is provided using a papermaking process generally as described with reference to FIG. 1 using tobacco by-products comprising a blend of tobacco types. The blend includes about 65 parts Burley and flue cured tobacco stems and about 35 parts of tobacco laminae dust and scrap.

The tobacco is extracted using tap water, and the aqueous tobacco extract is separated from the water insoluble pulp. The pulp, which has a very low remaining water extractable content, is formed into a sheet. The aqueous extract is concentrated to about 23.5 percent tobacco extractables, and exhibits a pH of about 4.8. The extract then is heated to about 130° F. The resulting aqueous extract, which weighs about 500 pounds of which about 23.5 percent thereof is tobacco extractables, then has a solution of about 1744 g diammonium hydrogen orthophosphate in about 5.8 l of water added thereto over about a 6 minute period. The aqueous extract so treated exhibits a pH of about 5.2 and is maintained at about 130° F. for about 2 minutes. Then, the pH of the aqueous extract is adjusted by adding concentrated ammonium hydroxide (i.e., about 512 g ammonia). The aqueous extract then exhibits a pH of about 6.0. The treated aqueous extract is about 23 percent treated tobacco solids and about 77 percent water.

The resulting extract then is sprayed onto the sheet which is formed from the insoluble pulp, such that a resulting sheet having a tobacco extract content of about 43 percent (on a dry weight basis) is provided. The sheet so provided is dried to a moisture level of about 12 to about 13 percent. The resulting sheet has a phosphate content of about 1.75 percent.

EXAMPLE 2

Reconstituted tobacco sheet is provided using a papermaking process generally as described with reference to FIG. 1 using tobacco by-products comprising a blend of tobacco types. The blend is described in Example 1.

The tobacco is extracted using tap water, and the aqueous tobacco extract is separated from the water insoluble pulp. The pulp, which has a very low remaining water extractable content, is formed into a sheet. The aqueous extract is concentrated to about 23.5 percent tobacco extractables, and exhibits a pH of about 4.9. The extract then is heated to about 130° F. The resulting aqueous extract, which weighs about 500 pounds, of which about 23.5 percent thereof is tobacco extractables, then is contacted with a solution of about 1162 g diammonium hydrogen orthophosphate in about 3.8 l of water added thereto over a 6 minute period. The aqueous extract so treated exhibits a pH of about 5.1 and is maintained at about 130° F. for about 2 minutes. Then, the pH of the aqueous extract is adjusted to about 6.5 using ammonium hydroxide. The treated aqueous extract is about 23 percent treated tobacco solids and about 77 percent water.

The resulting extract then is sprayed onto the sheet which is formed from the insoluble pulp, such that a resulting sheet having a tobacco extract content of about 43 percent (on a dry weight basis) is provided. The sheet so provided is dried to a moisture level of about 12 to about 13 percent.

EXAMPLE 3

Reconstituted tobacco sheet is provided using a papermaking process generally as described with reference to FIG. 1 using tobacco by-products comprising a blend of tobacco types. The blend is described in Example 1.

The tobacco is extracted using tap water, and the aqueous tobacco extract is separated from the water insoluble pulp. The pulp, which has a very low remaining water extractable content, is formed into a sheet. The aqueous extract is concentrated to about 23.5 percent tobacco extractables, and exhibits a pH of about 4.8. The extract then is heated to about 130° F. The resulting aqueous extract, which weighs about 500 pounds of which about 23.5 percent thereof is tobacco extractables, then has a solution of about 1162 g diammonium hydrogen orthophosphate and about 528 g urea in about 5.1 of water added thereto over about a 6 minute period. The aqueous extract so treated exhibits a pH of about 5.1 and is maintained at about 130° F. for about 2 minutes. Then, the pH of the aqueous extract is adjusted by adding concentrated ammonium hydroxide (i.e., about 491 g ammonia). The aqueous extract then exhibits a pH of about 6. The treated aqueous extract is about 23 percent treated tobacco solids and about 77 percent water.

The resulting extract then is sprayed onto the sheet which is formed from the insoluble pulp, such that a resulting sheet having a tobacco extract content of about 43 percent (on a dry weight basis) is provided. The sheet so provided is dried to a moisture level of about 12 to about 13 percent.

EXAMPLE 4

Reconstituted tobacco sheet is provided using a papermaking process generally as described with reference to FIG. 1 using tobacco by-products comprising a blend of tobacco types. The blend is described in Example 1.

The tobacco is extracted using tap water, and the aqueous tobacco extract is separated from the water insoluble pulp. The pulp, which has a very low remaining water extractable content, is formed into a sheet. The aqueous extract is concentrated to about 23.5 percent tobacco extractables, and exhibits a pH of about 4.9. The extract then is heated to about 130° F. The resulting aqueous extract, which weighs about 500 pounds of which about 23.5 percent thereof is tobacco extractables, then has a solution of about 1744 g diammonium hydrogen orthophosphate and about 793 g urea in about 7 l of water added thereto over about a 6 minute period. The aqueous extract so treated exhibits a pH of about 5.2 and is maintained at about 130° F. for about 2 minutes. Then, the pH of the aqueous extract is adjusted by adding concentrated ammonium hydroxide (i.e., about 504 g ammonia). The aqueous extract then exhibits a pH of about 6. The treated aqueous extract is about 23 percent treated tobacco solids and about 77 percent water.

The resulting extract then is sprayed onto the sheet which is formed from the insoluble pulp, such that a resulting sheet having a tobacco extract content of about 43 percent (on a dry weight basis) is provided. The sheet so provided is dried to a moisture level of about 12 to about 13 percent.

EXAMPLE 5

Reconstituted tobacco sheet is provided using a papermaking process generally as described with reference to FIG. 1 using tobacco by-products comprising a blend of tobacco types. The blend is described in Example 1.

The tobacco is extracted using tap water, and the aqueous tobacco extract is separated from the water insoluble pulp. The pulp, which has a very low remaining water extractable content, is formed into a sheet. The aqueous extract is concentrated to about 23.5 percent tobacco extractables, and exhibits a pH of about 4.9. The extract then is heated to about 130° F. The resulting aqueous extract, which weighs about 500 pounds of which about 23.5 percent thereof is tobacco extractables, then has a solution of about 1744 g diammonium hydrogen orthophosphate in about 5.8 l of water added thereto over about a 6 minute period. The aqueous extract so treated exhibits a pH of about 5.2 and is maintained at about 130° F. for about 2 minutes. Then, the pH of the aqueous extract is adjusted by adding concentrated ammonium hydroxide (i.e., about 653 g ammonia). The aqueous extract then exhibits a pH of about 6.5. The treated aqueous extract is about 23 percent treated tobacco solids and about 77 percent water.

The resulting extract then is sprayed onto the sheet which is formed from the insoluble pulp, such that a resulting sheet having a tobacco extract content of about 43 percent (on a dry weight basis) is provided. The sheet so provided is dried to a moisture level of about 12 to about 13 percent.

What is claimed is:

1. A process for providing a reconstituted tobacco material, the process comprising the steps of:

(a) extracting components from tobacco material using a solvent having an aqueous character thereby providing (i) a solvent having extracted tobacco components therein, and (ii) a tobacco portion insoluble in the solvent;

(b) separating at least a portion of the solvent and extracted tobacco components therein from the insoluble tobacco portion; and then (c) forming the insoluble tobacco portion into a predetermined shape;

(d) contacting the solvent and extracted tobacco components provided in step (b) with a water soluble phosphate salt;

(e) providing the portion of solvent and extracted components provided in step (d) at a pH of above about 5.5 to about 8; and (f) contacting the insoluble tobacco portion of step (c) with the solvent and extracted tobacco components of step (d) to provide a phosphate-containing tobacco material.

2. The process of claim 1 whereby the solvent and extracted tobacco components are contacted with diammonium hydrogen orthophosphate.

3. The process of claim 1 whereby the insoluble tobacco portion is formed into a sheet-like shape.

4. The process of claim 3 whereby the tobacco material provided in step (e) is dried to a moisture content of about 10 to about 15 weight percent.

5. The process of claim 1 or 2 whereby the water soluble phosphate salt is contacted with the solvent and extract which are maintained at a temperature of about 110° F. to about 160° F.

6. The process of claim 4 whereby the solvent and extracted components are contacted with sufficient phosphate salt in step (d) such that the phosphate content of the resulting reconstituted tobacco material is about 1 percent to about 2.5 percent, based on the dry weight of that resulting material.

7. The process of claim 1 whereby the portion of solvent and extracted components provided in step (e) are provided at a pH of about 5.6 to about 6.8.

8. The process of claim 1 whereby the portion of solvent and extracted components provided in step (e) are provided at a pH of about 6 or above.

9. The process of claim 1 whereby step (e) includes contacting the solvent and extracted tobacco with ammonia or ammonium hydroxide.

10. The process of claim 1 whereby the solvent and extract of step (e) are maintained at a temperature of about 100° F. to about 200° F.

* * * * *